US006482047B1

(12) United States Patent
Lytle, Jr. et al.

(10) Patent No.: US 6,482,047 B1
(45) Date of Patent: Nov. 19, 2002

(54) TERMINAL POSITION ASSURANCE AND LOCK DEVICE

(75) Inventors: Joseph Donald Lytle, Jr., Youngstown, OH (US); Donald John Mizner, Sharpsville, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/854,989

(22) Filed: May 14, 2001

(51) Int. Cl.[7] ..... H01R 13/436
(52) U.S. Cl. ..... 439/752
(58) Field of Search ..... 439/752, 595

(56) References Cited

U.S. PATENT DOCUMENTS 4,992,063 A 2/1991 Stein, Sr.
5,145,356 A 9/1992 Minnis
6,045,412 A * 4/2000 Guanco et al. ..... 439/752

* cited by examiner

*Primary Examiner*—Gary F. Paumen
(74) *Attorney, Agent, or Firm*—Thomas N. Twomey

(57) ABSTRACT

An electrical connector has a terminal position assurance and lock device that acts as both a stop behind receptacle portions of electrical terminals and to prevent flexing of a first and second set of cavity flex lock arms which retain the electrical terminals in the connector to positively position the electrical terminals and prevent their inadvertent withdrawal from the electrical connector. Insertion of an electrical terminal into a terminal cavity causes the cavity flex lock arm in the cavity to flex inwardly, permitting the electrical terminal to be received in the cavity. Once an electrical terminal is inserted past the cavity flex lock arm, the lock arm returns to its unflexed position to retain the electrical terminal. The terminal position assurance and lock device preferably has three fingers and is releasably inserted into a mating formation of passages that extend laterally through the length of the electrical connector generally transverse to the orientation of the electrical terminals positioned in the terminal cavities. Two of the fingers pass behind receptacle portions of the electrical terminals to act as stops, preventing the electrical terminals from being removed from the electrical connector, while the third finger passes between the first and second sets of cavity flex lock arms to prevent the lock arms from flexing inward significantly such that inadvertent withdrawal of the electrical terminals is prevented. When desired, the terminal position assurance and lock device can be removed to facilitate removal of the electrical terminal ends from the electrical connector.

6 Claims, 2 Drawing Sheets

TERMINAL POSITION ASSURANCE AND LOCK DEVICE

TECHNICAL FIELD

The invention relates generally to electrical connectors and more specifically to electrical connectors that have a separate lock piece that is attached to a connector body to prevent withdrawal of terminals disposed in terminal cavities in the connector body.

BACKGROUND OF THE INVENTION

An electrical connector commonly has an electrical lead with an electric terminal attached thereto and which is inserted into a cavity in the electrical connector. U.S. Pat. No. 4,992,063 granted to William L. Stein, Sr. discloses an electrical connector having a connector body with two rows of cavities and electric terminals having depending stop tabs disposed therein which limit insertion of the terminals into the cavities. A separate bifurcated lock member is attached to the connector body by inserting the lock member between, generally parallel to, and in the direction of insertion of the terminals into the cavities to prevent withdrawal of the electrical terminals disposed in the terminal cavities. The bifurcated lock member acts as a stop behind the depending stop tabs of the electric terminals.

U.S. Pat. No. 5,145,356 granted to Alan J. Minnis discloses an electrical connector having a receptacle portion with cavities for receiving up to twelve electrical terminals each having a receptacle end and a lead end. The receptacle end is locked into the cavity by a latch arm that flexes outwardly when the receptacle is inserted into the cavity, then returns to a non-flexed position once the receptacle end bypasses the latch arm such that a catch of the latch overlies a portion of the receptacle end of the terminal to resist withdrawal of the terminal. To prevent the latch arm from inadvertently deflecting outwardly once the receptacle end is locked in position, an anti-backout insert having three rows of anti-backout spigots is inserted into a side of the receptacle portion opposite the terminal lead insertion side. The anti-backout spigots are inserted behind the lock arms such that they are prevented from deflecting outwardly. By preventing outward deflection of the lock arms, the receptacle end of the terminal is locked into position.

SUMMARY OF THE INVENTION

The invention provides an electrical connector having a terminal position assurance and lock device that acts as both a stop behind receptacle portions of electrical terminals and to prevent flexing of cavity flex lock arms which retain the electrical terminals in the electrical connector to positively position the electrical terminals and prevent their inadvertent withdrawal from the electrical connector. Insertion of the electrical terminal into a terminal cavity causes the cavity flex lock arm in the cavity to flex inwardly, permitting the electrical terminal to be received in the cavity. Once the electrical terminal is inserted, the lock arm returns to its unflexed position to retain the electrical terminal. The terminal position assurance and lock device has at least two fingers and is releasably inserted into a mating formation of passages that extend laterally through the length of the electrical connector generally transverse to the orientation of the electrical terminals positioned in the terminal cavities. One of the fingers passes behind receptacle portions of the electrical terminals to act as stops, preventing the electrical terminals from being removed from the electrical connector.

The second finger passes next to the cavity flex lock arms to prevent the lock arms from flexing inward significantly such that inadvertent withdrawal of the electrical terminals is prevented. When desired, the terminal position assurance and lock device can be removed to facilitate removal of the electrical terminal ends from the electrical connector.

Accordingly, one advantage of the current invention is to provide a terminal position assurance and lock device that functions as both a terminal stop and to prevent inadvertent flexing of the cavity flex lock arms to provide terminal position assurance and retain the terminals in their cavities.

Another advantage of the invention is that the terminal position assurance and lock device is inserted and extends transversely to the direction of the terminal end insertion to provide a secure locking mechanism that resists becoming loosened from movement of the electrical terminals.

Another advantage of the invention is to provide a terminal position assurance and lock device that is easy to both assemble and disassemble from the electrical connector.

Yet another advantage of the invention is to provide an easy to manufacture terminal position assurance and lock device to reduce the total cost of manufacturing electrical connector components.

BRIEF DESCRIPTION OF THE DRAWINGS

The invention will now be described, by way of example, with reference to the accompanying drawings in which.

DESCRIPTION OF THE PREFERRED EMBODIMENTS

Figures 1, 4:
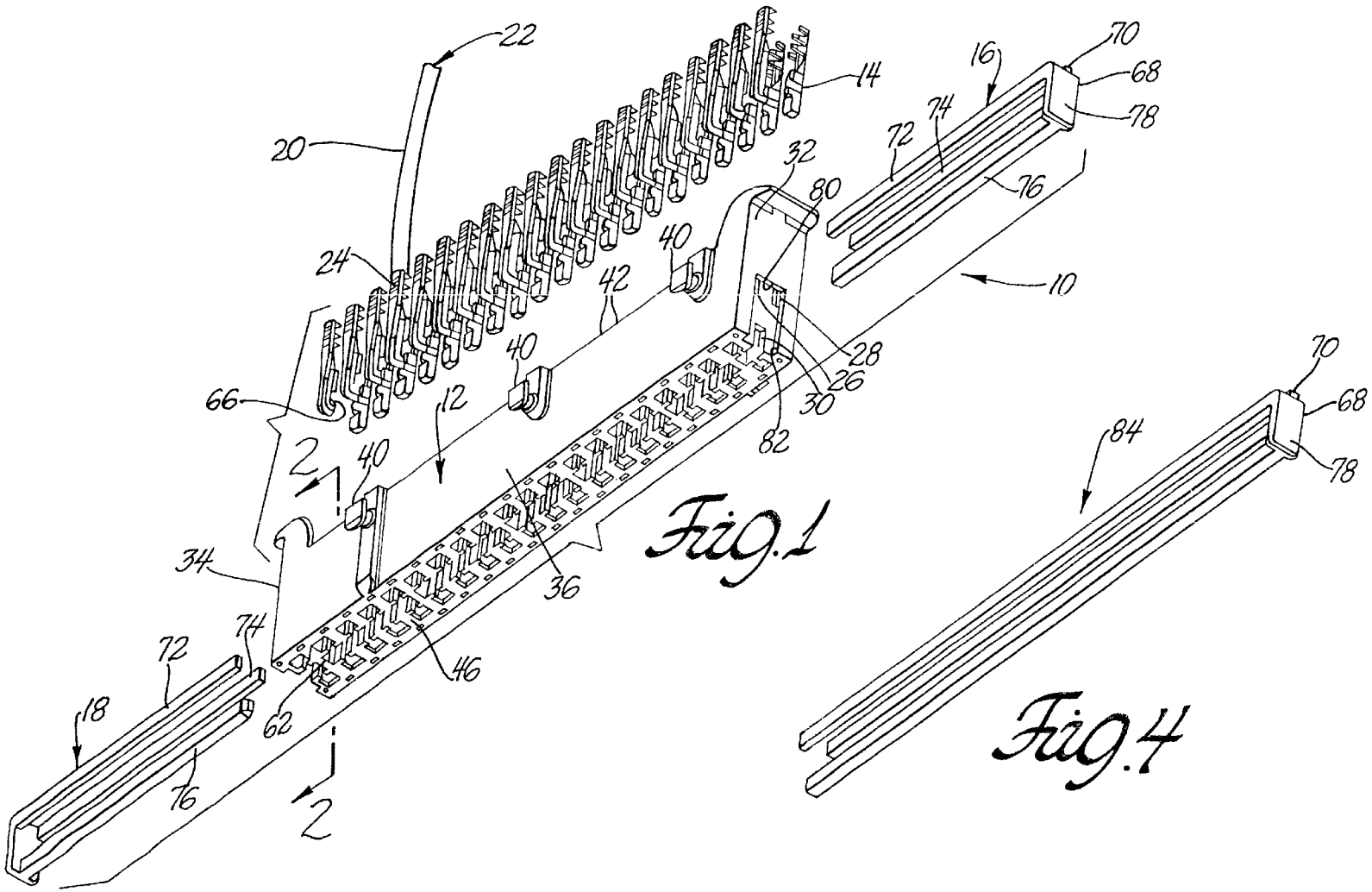
FIG. 1 is an exploded perspective view of an electrical connector assembly embodying the present invention.
FIG. 4 is an perspective view of an alternate embodiment of a single terminal position assurance and lock device spanning the length of the connector body.

Referring in more detail to the drawings, FIG. 1 illustrates an electrical connector 10 having a connector body 12 which, in assembly, receives a plurality of electrical terminals 14 and first and second terminal position assurance and lock devices 16, 18 which are inserted into the connector body 12 to maintain the position of the electrical terminals 14 in the connector body 12 and to prevent the electrical terminals 14 from being inadvertently removed from the connector body 12. The electrical terminals 14 are connected to electrical leads 20 of electrical cables 22 by conventional cable attachment portions 24. After the electrical terminals 14 are inserted into the connector body 12, the first and second terminal position assurance and lock devices 16, 18 are releasably inserted into complementary first, second, and third passages 26, 28, 30 in the connector body 12 to both operate as a stop behind receptacle portions 15 of the electrical terminals 14 and to prevent the electrical terminals 14 from inadvertently releasing from the connector body 12 by retaining them in their respective positions.

The connector body 12 has opposed end walls 32, 34 and opposed front and rear walls 36, 38 extending between the end walls 32, 34. The front and rear walls 36, 38 each preferably have three outwardly extending locking tabs 40 for aligning and locking the connector body 12 to another connector body (not shown). The end walls 32, 34 each have a recess 82 with a relief 80 generally in the upper portion for releasably receiving the terminal position assurance and locking devices 16, 18.

Figure 2:
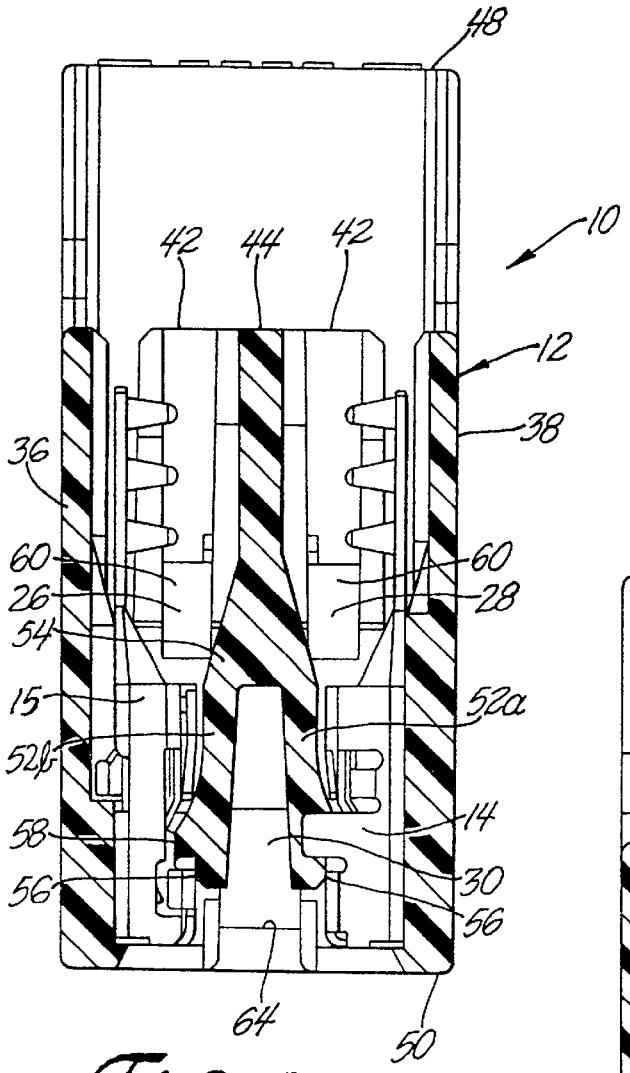
FIG. 2 is a cross-sectional view of the connector assembly of FIG. 1 showing electrical terminals inserted into the electrical connector without a terminal position assurance and lock device inserted into the electrical connector.

As best shown in FIGS. 1 and 2, the connector body 12 has terminal cavities 42 on opposite sides of a divider wall 44 which extends generally parallel to and between the front and rear walls 36, 38 of the connector body 12. The terminal cavities 42 are separated from each other by a plurality of partitions 46 that extend outwardly from and generally orthogonal to the divider wall 44. The divider wall 44 extends from an upper surface 48 of the connector body 12 downwardly to approximately halfway between the upper surface 48 and a bottom surface 50 of the connector body 12. A plurality of bifurcated portions having first and second sets of cavity flex lock arms 52*a*, 52*b* extend downwardly from a bottom portion 54 of the divider wall 44 and the first and second sets of cavity flex lock arms 52*a*, 52*b* are disposed generally between a pair of partitions 46. The first and second sets of cavity flex lock arms 52*a*, 52*b* have a free end 56 with an outwardly extending locking tab 58 for retaining the electrical terminals 14 in the terminal cavities 42.

The first, second, and third passages 26, 28, 30 each extend through the length of the connector body 12 generally parallel to the front and rear walls 36, 38 and between and through the end walls 32, 34. The first and second passages 26, 28 are substantially parallel to each other and are formed by a series of aligned openings 60 in the partitions 46 with the openings 60 being generally equidistant from the bottom surface 50 of the connector body 12. The third passage 30 runs between the first and second sets of cavity flex lock arms 52*a*, 52*b* with a plurality of cross bars 62 generally flush with the bottom surface 50 of the connector body 12 and passing between the front and back walls 36, 38 to define a bottom 64 of the third passage 30.

To insert an electrical terminal 14 having a recess 66 into its corresponding terminal cavity 42, the electrical terminal 14 is slidably pushed into a terminal cavity 42 until it engages and displaces the locking tab 58 of a cavity flex lock arm 52*a* or 52*b* in the terminal cavity 42 causing the cavity flex lock arm 52*a* or 52*b* to flex inwardly to permit the electrical terminal 14 to pass. Upon full insertion of the electrical terminal 14 into its terminal cavity 42, the recess 66 of the electrical terminal 14 becomes aligned with the locking tab 58 permitting the cavity flex lock arm 52*a* or 52*b* to return to its unflexed position with the locking tab 58 received in the recess 66 in the electrical terminal 14 to retain the electrical terminal 14 in its terminal cavity 42.

After the electrical terminals 14 are inserted into the terminal cavities 42 such that they are retained at least in part by the first and second sets of cavity flex lock arms 52*a*, 52*b* in the terminal cavities 42 of the electrical connector 10, the first and second terminal position assurance and lock devices 16, 18 are inserted into the connector body 12. The first and second terminal position assurance and lock devices 16, 18 are substantially identical to each other with each having a support plate 68 with spaced apart, elongate first, second and third fingers 72, 74, 76 extending generally orthogonally from the support plates 68. The first, second and third fingers 72, 74, 76 extend generally parallel to each other and are preferably integral with the support plate 68. In assembly, each finger 72, 74, 76 is slidably inserted and received in a separate one of the first, second, and third passages 26, 28, 30 in the connector body 12, respectively, such that each finger 72, 74, 76 on each terminal position assurance and lock device 16, 18 extends generally half-way through the connector body 12 and extends generally transversely to the direction of insertion or removal of the electrical terminals 14. Thus, with one terminal position assurance and lock device 16 inserted through one end wall 32 and the other terminal position assurance and lock device 18 inserted through the other end wall 34, the devices 16, 18 are received adjacent to and positively retain each electrical terminal 14 in the connector body 12.

Figure 3:
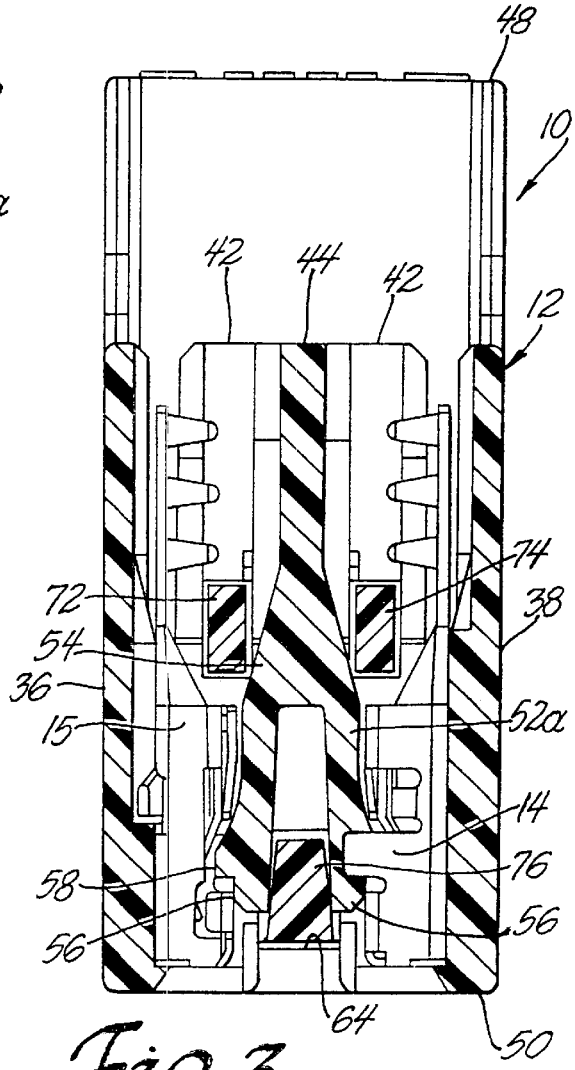
FIG. 3 is a cross-sectional view as in FIG. 2 showing the electrical terminals inserted into the electrical connector and a terminal position assurance and lock device inserted into the electrical connector.

As best shown in FIG. 3, the first and second fingers 72, 74 of each terminal position assurance and lock device 16, 18 are inserted into the first and second passages 26, 28 so that they are received preferably directly behind the receptacle portions 15 of the fully inserted electrical terminals 14. The first and second fingers 72, 74 act as stops and are engaged by the electrical terminals 14 if the electrical terminals 14 are moved in a direction opposite that of their insertion into the terminal cavities 42 to prevent removal of the electrical terminals 14 from their respective terminal cavities 42 and to limit movement of the electrical terminal 14 within the terminal cavities 42.

The third finger 76 of each terminal position assurance and lock device 16, 18 is inserted into the third passage 30 so that it is received between the first and second sets of cavity flex lock arms 52*a*, 52*b*. The third finger 76 prevents the first and second sets of cavity flex lock arms 52*a*, 52*b* from flexing inward significantly so that the locking tabs 58 remain inserted in the recesses 66 of the electrical terminals 14 to prevent the electrical terminals 14 from being removed from the terminal cavities 42. So positioned, the locking tabs 58 are engaged by the electrical terminals 14 if the electrical terminals 14 are moved in a direction tending to remove them from the terminal cavities 42 to prevent removal of the terminals 14 from the terminal cavities 42.

When the terminal position assurance and lock devices 16, 18 are fully inserted into the connector body 12, faces 78 on the support plates 68 of the first and second terminal position assurance and lock devices 16, 18 seat flush with the opposed end walls 32, 34 of the connector body 12. Preferably, the support plates 68 each have a locking tab 70 generally on the upper portion of the support plate 68 for mating with the reliefs 80 in the recesses 82 in the opposed end walls 32, 34. When the faces 78 of the support plates 68 are seated flush with the opposed end walls 32, 34 of the connector body 12, the locking tabs 70 snap into the reliefs 80 to releasably secure the terminal position assurance and lock devices 16, 18 in the connector body 12.

Thus, the terminal position assurance and lock devices 16, 18 act as both a stop with the first and second fingers 72, 74 positioned behind the receptacle portions 15 of the electrical terminals 14 to prevent the electrical terminals 14 from being withdrawn from the terminal cavities 42, and also prevent unwanted flexing of the first and second sets of cavity flex lock arms 52*a*, 52*b* to maintain the position of the electrical terminals 14 and to provide another means for preventing their withdrawal from the terminal cavities 42 in the connector body 12. Notably, the terminal position assurance and lock devices 16, 18 extend transversely to the direction of electrical terminal 14 removal to provide a positive stop and lock for each electrical terminal 14 which cannot be overcome without breaking the first and second fingers 72, 74 of the terminal position assurance and lock devices 16, 18. Further, the transverse insertion of the terminal position assurance and lock devices 16, 18 resists loosening or unintended removal of the devices 16, 18 from the connector body 12.

It will be appreciated by those skilled in the art that modifications and variations of this invention may be made without departing from the spirit and scope of the invention. For example, as shown in FIG. 4, one variation is to have a single terminal position assurance and lock device 84 with a length generally equal to that of the connector body 12 releasably received in the connector body 12. Thus, the single terminal position assurance and lock device 84 positively retains and positions each terminal 14 in the connector body 12. The remainder of the electrical connector assembly is preferably identical to that of the previous embodiment and hence, will not be described further. It is also possible to have a terminal position assurance and lock device or devices 16, 18 associated in a single row electrical connector in which case each device 16, 18 would have two fingers; one to provide a positive stop behind the receptacle portions 15 of the electrical terminals 14, and the other to prevent flexing of the cavity flex lock arms 52*a* or 52*b*.

What is claimed is:

1. An electrical connector comprising:

electrical cables having electrical terminals at one end;

a connector body having a divider wall with opposite sides, terminal cavities on opposite sides of the divider wall, and partitions separating adjacent terminal cavities with each of the terminal cavities being adapted to receive one of the electrical terminals;

the divider wall having bifurcated portions that provide a first set of cavity flex lock arms that extend part way into the terminal cavities on one side of the divider wall and a second set of cavity flex arms that extend part way into the terminal cavities on an opposite side of the divider wall, such that the cavity flex lock arms flex inwardly to releasably receive the electrical terminals in the terminal cavities and return to an unflexed position to retain the electrical terminals;

the connector body having substantially parallel first and second passages extending through the length of the connector body generally transverse to the direction of insertion of the terminals and passing through the partitions on opposite sides of the divider wall;

the connector body having a third passage extending through the length of the connector body between the first and second sets of cavity flex lock arms and generally transverse to the direction of insertion of the terminals;

at least one terminal position assurance and lock device having three elongate fingers, with a first finger and a second finger each slidably received in a separate one of the first and second passages to act as stops directly behind receptacle portions of the electrical terminals to prevent the electrical terminals from being removed from the terminal cavities, and a third finger which is slidably received in the third passage between the first and second sets of cavity flex lock arms to prevent the cavity flex lock arms from flexing inwardly and releasing the electrical terminals from the terminal cavities, and a support plate integral with the three fingers of the terminal position assurance and lock device, and a locking tab on the support plate for releasably securing the terminal position assurance and lock device to the connector body after the three fingers are inserted into the first, second, and third passages of the electrical connector.

2. An electrical connector as defined in claim 1 wherein a single terminal position assurance and lock device is provided and each of the first, second, and third fingers are of a length to extend sufficiently through their respective passages to retain each terminal in its corresponding cavity.

3. An electrical connector, comprising: electrical cables having electrical terminals at one end;

a connector body having a divider wall with opposite sides, terminal cavities on opposite sides of the divider wall, and partitions separating adjacent terminal cavities with each of the terminal cavities being adapted to receive one of the electrical terminals;

the divider wall having bifurcated portions that provide a first set of cavity flex lock arms that extend part way into the terminal cavities on one side of the divider wall and a second set of cavity flex arms that extend part way into the terminal cavities on an opposite side of the divider wall, such that the cavity flex lock arms flex inwardly to releasably receive the electrical terminals in the terminal cavities and return to an unflexed position to retain the electrical terminals;

the connector body having substantially parallel first and second passages extending through the length of the connector body generally transverse to the direction of insertion of the terminals and passing through the partitions on opposite sides of the divider wall;

the connector body having a third passage extending through the length of the connector body between the first and second sets of cavity flex lock arms and generally transverse to the direction of insertion of the terminals;

at least one terminal position assurance and lock device having three elongate fingers, with a first finger and a second finger each slidably received in a separate one of the first and second passages to act as stops directly behind receptacle portions of the electrical terminals to prevent the electrical terminals from being removed from the terminal cavities, and a third finger which is slidably received in the third passage between the first and second sets of cavity flex lock arms to prevent the cavity flex lock arms from flexing inwardly and releasing the electrical terminals from the terminal cavities;

a pair of generally opposed end walls on the connector body with said at least one terminal position assurance and lock device initially received in the connector body through one end wall; and a second terminal position assurance and lock device having three fingers initially slidably received in the connector body through the other end wall generally opposed to said one end wall with a first finger and a second finger each slidably received in a separate one of the first and second passages to act as stops directly behind receptacle portions of the electrical terminals to prevent the electrical terminals from being removed from their cavities, and a third finger which is slidably received in the third passage between the first and second sets of cavity flex lock arms to prevent the cavity flex lock arms from flexing inwardly and releasing the electrical terminals.

4. An electrical connector as defined in claim 3 wherein the first and second fingers of each terminal position assur ance and lock device, when fully inserted into the connector body, extend approximately half-way through the connector body so that when both terminal position assurance and lock devices are fully inserted in the connector body, the first and second fingers provide a stop for each of the electrical terminals.

5. An electrical connector as defined in claim 3 wherein the third finger of each terminal position assurance and lock device, when fully inserted into the connector body, extends approximately half-way through the connector body so that when both terminal position assurance and lock devices are fully inserted in the connector body, the third finger is received adjacent to each of the cavity flex lock arms to prevent them from being significantly flexed.

6. An electrical connector as defined in claim 3 which also comprises a support plate integral with the three fingers of each terminal position assurance and lock device with each support having a locking tab for releasably securing each terminal position assurance and lock device to the connector body after their fingers are inserted into the first, second, and third passages of the electrical connector.

* * * * *